US005926092A

United States Patent [19]

Kim

[11] Patent Number: 5,926,092

[45] Date of Patent: Jul. 20, 1999

[54] THEFTPROOF DEVICE FOR COMPUTER SYSTEM

[75] Inventor: Seung-chan Kim, Seoul, Rep. of Korea

[73] Assignee: Kyungki System Co., Ltd., Seoul, Rep. of Korea

[21] Appl. No.: 09/030,993

[22] Filed: Feb. 26, 1998

Related U.S. Application Data

[30] Foreign Application Priority Data

Feb. 26, 1997 [KR] Rep. of Korea ..... 97-6007

[51] Int. Cl.[6] ..... G08B 13/14

[52] U.S. Cl. ..... 340/571; 340/568.1; 340/652; 340/693.9

[58] Field of Search ..... 340/571, 568, 340/539, 693, 652, 541, 545, 568.1, 568.2, 693.1, 693.5, 693.9, 545.2, 545.3, 545.6

[56] References Cited

U.S. PATENT DOCUMENTS

| | | | |
|---|---|---|---|
| 4,908,608 | 3/1990 | Reinke et al. | 340/571 |
| 4,945,341 | 7/1990 | Buttimer | 340/568 |
| 4,985,695 | 1/1991 | Wilkinson et al. | 340/571 |
| 4,999,621 | 3/1991 | Loeb | 340/571 |
| 5,317,304 | 5/1994 | Choi | 340/571 |
| 5,675,321 | 10/1997 | McBride | 340/571 |
| 5,714,933 | 2/1998 | Le Van Suu | 340/539 |
| 5,748,083 | 5/1998 | Rietkerk | 340/571 |
| 5,757,271 | 5/1998 | Andrews | 340/568 |
| 5,760,690 | 6/1998 | French | 340/568 |

*Primary Examiner*—Jeffery A. Hofsass
*Assistant Examiner*—Anh La
*Attorney, Agent, or Firm*—Dvorak & Orum

[57] ABSTRACT

A theftproof device for a computer according to the present invention is provided. The theftproof device includes a PCB installed in a predetermined portion of the inside of a computer, an external connector portion provided on one side of the PCB for connecting to external cables, a vibration sensor installed on the PCB for sensing vibrations of the main frame of the computer, an alarm installed on the PCB for sounding an alarm when the main frame of the computer vibrates, a circuit provided on the PCB for receiving a signal input through the external connector portion and a signal from the vibration sensor, controlling the alarm, and performing communications with the computer system, and dip switches for setting the communication state between the circuit and the computer system. According to the above-mentioned system, it is possible to prevent the computer and the main parts thereof from being stolen since an alarm sounds by the operation of sensors when the main board of the computer vibrates or a cable connecting the main board of the computer to peripheral devices is disconnected. Also, it is possible to obtain a security system since it is possible to control doors with external sensors and to indicate whether something is wrong with the computer using a remote controller.

2 Claims, 3 Drawing Sheets

THEFTPROOF DEVICE FOR COMPUTER SYSTEM

BACKGROUND OF THE INVENTION

1. Field of the Invention

The present invention relates to a theftproof device for a computer system, and more particularly, to a theftproof device for a computer system for preventing the main board and the display device of a computer and the main parts connected to the main board of the computer from being stolen by providing an assembled theftproof device in the main board of the computer.

2. Description of the Related Art

In recent years, computer use has increased significantly in private businesses and in the public sector. In such business settings or in public institutions, although computers may be used individually, they are usually part of a network. In such a network, a multitude of individual computers (clients) are connected to one or more host computers (servers).

With computers being used in such a manner, computers are often stolen since anyone can easily gain access to the computers and since a device for preventing computers from being stolen are not provided. In particular, the CPU, high-priced memory chips and other devices installed in the main board of the computer are often stolen.

SUMMARY OF THE INVENTION

It is an object of the present invention to provide a theftproof device for a computer system for preventing theft of the main board and the monitor of a computer and the main parts connected to the main board of the computer.

To achieve the above object, there is provided a theftproof device for a computer system according to the present invention, comprising a PCB installed in a predetermined portion of the inside of a computer, an external connector portion provided on one side of the PCB for connecting to external cables, a vibration sensor installed on the PCB for sensing vibrations of the main frame of the computer, an alarm installed on the PCB for sounding an alarm when the main frame of the computer vibrates, a circuit provided on the PCB for receiving a signal input through the external connector portion and a signal from the vibration sensor, controlling the alarm, and performing communications with the computer system, and dip switches for setting the communication state between the circuit and the computer system.

According to the system according to the present invention, it is possible to prevent the computer and the main parts of the computer from being stolen since an alarm is sounded with the operation of a sensor when the main board of the computer vibrates or cables connecting the main board of the computer to peripheral devices are disconnected.

BRIEF DESCRIPTION OF THE DRAWING(S)

The above object and advantages of the present invention will become more apparent by describing in detail a preferred embodiment thereof with reference to the attached drawings in which:

FIG. 1 schematically illustrates a theftproof device for a computer system according to the present invention;

DESCRIPTION OF THE PREFERRED EMBODIMENT(S)

Figure 1:
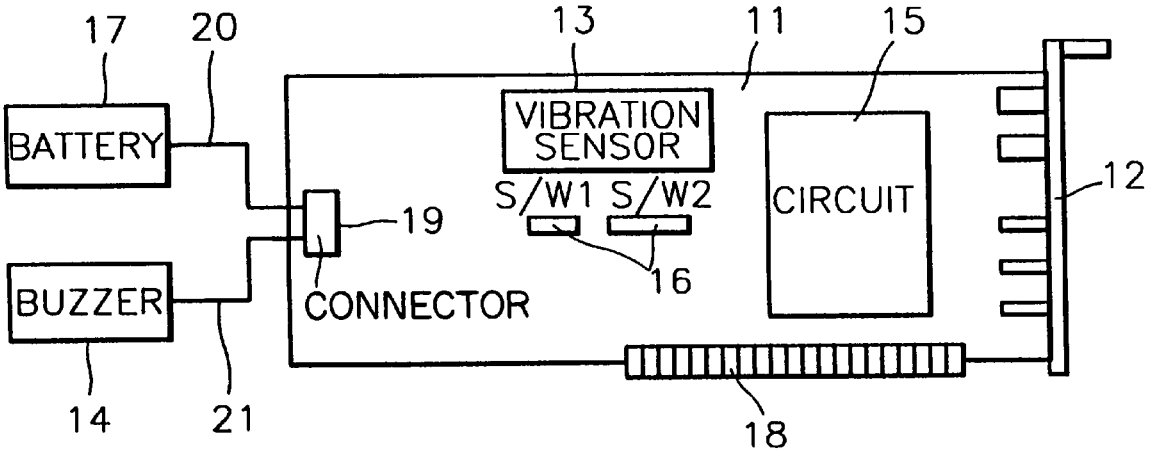

Referring to FIG. 1, a theftproof device 10 of a computer system according to the present invention connects to a bus connector of a main board(not shown) of a computer and includes a PCB 11, an external connector portion 12 installed on one side of the PCB 11 for connecting external cables, a vibration sensor 13 installed on the PCB 11 for sensing vibrations of the main board of the computer, a buzzer 14 installed close to the PCB 11 for sounding an alarm when the main board of the computer vibrates, a circuit 15 installed in the substrate 11 for receiving signals input through the external connector portion 12 and a signal from the vibration sensor 13 for controlling the buzzer 14, sounding an alarm, and communicating with the computer system, and dip switches S/W1 and S/W2 16 for setting the communication switches between the circuit 15 and the computer system, the duration of the alarm of the buzzer 14, the alarm sounding mode, and whether or not an outer sensor is to be used. Preferably, a battery 17 for providing an additional direct current power source as a provision against a breakdown of electric current is further provided close to the PCB 11. Reference numeral 18 denotes a slot contact terminal for connecting the PCB 11 to the main board. Reference numeral 19 denotes a connector for connecting the buzzer 14 and the battery 17 to the PCB 11. Reference numerals 20 and 21 denote connection lines.

Figure 2:
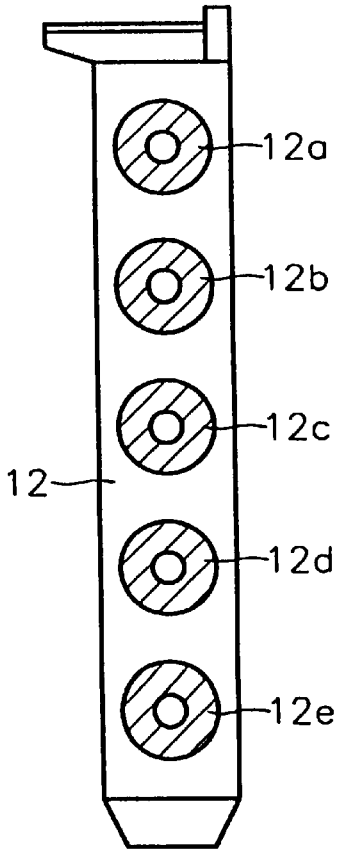
FIG. 2 shows the outer connectors of the theftproof device shown in FIG. 1 in detail.

The external connector portion 12, as shown in FIG. 2, includes a connector 12*a* for sensing the removal of a cable connecting the main board of the computer to peripheral equipments, a connector 12*b* for an external antenna for transmitting a signal to indicate a state of emergency from the circuit 15 to a remote controller, a connector 12*c* for an adaptor for providing power to the circuit 15 on the PCB 11 and main elements thereof, a connector 12*d* for a magnetic sensor attached to a door for sensing entrance and exit, and a connector 12*e* for an infrared sensor installed on a door or a window for sensing the entrance and exit.

Figure 3:
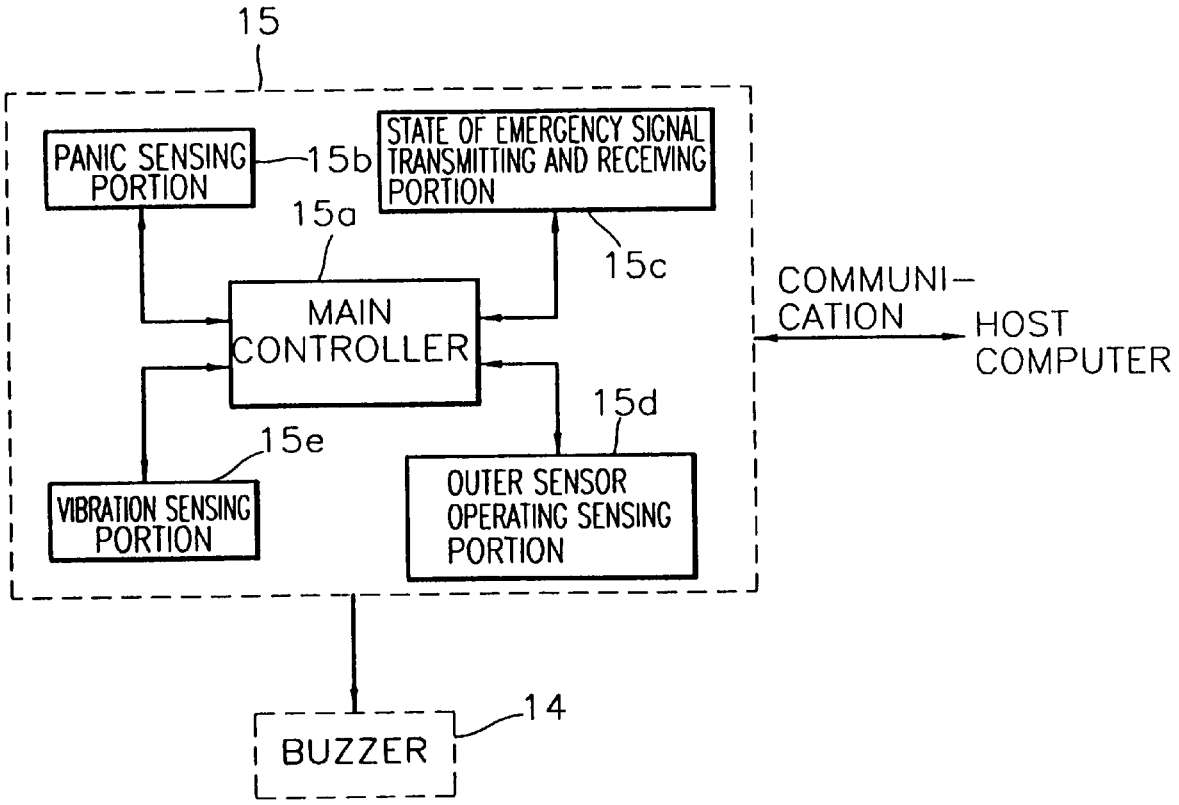
FIG. 3 is a block diagram schematically showing the inner structure of the circuit of the theftproof device shown in FIG. 1.

Also, the circuit 15, as shown in FIG. 3, includes a panic sensing portion 15*b* for sensing the removal of a cable connecting the main board of the computer to peripheral equipments, a state of emergency signal transmitting and receiving portion 15*c* for sensing whether or not something is wrong with the computer and for informing the remote controller the state of emergency, an external sensor operation sensing portion 15*d* for sensing whether or not something is wrong with the computer due to the operation of an outer sensor installed outside of the computer such as the magnetic sensor or the infrared sensor, a vibration sensing portion 15*e* for receiving a sense signal from the vibration sensor 13 and processing it and a main controller 15*a* for controlling the sensing portions, for receiving signals from the sensing portions, for transmitting an alarm sounding command signal to the buzzer 14, and for communicating with the computer system. A microprocessor can be used as the main controller 15*a*.

The use and operation of the theftproof system of a computer according to the present invention having the above-mentioned structure will be described with reference to FIGS. 1 through 3.

In order to employ the theftproof device for a computer system according to the present invention, preferably, there is at least 8 MB of RAM as the system memory and there is at least 10 MB of free hard disk space. In a preferred embodiment of the present invention, the operating system of the computer is a version of Windows™ (Windows 3.1 or Windows 95). Also, preferably, a modem (phone or cable) or a LAN card is used as a means for communicating with the server. It should be evident that the device of the present invention can easily be configured for other operating systems with different requirements.

The theftproof device for a computer system according to the present invention is installed in an appropriate bus slot of the main board of the computer. Here, an alarm sounds when the PCB 11 vibrates. The alarm is canceled by pressing an off button of the remote controller. When the PCB 11 is loaded, the device is converted goes into a warning mode by pressing an on button of the remote controller. Then, a volume control (not shown) of the vibration sensor 13 is appropriately controlled, inflicting a shock to the computer. However, the volume control need not necessarily be performed because the initial setting of the volume control (not shown) of the vibration sensor 13 is already at an appropriate level when shipped. When the above-mentioned control is completed, a jack of an adaptor for receiving an alternating current and outputting a direct current is inserted into the connector terminal 12*c* of the external connector portion 12. Accordingly, the installation of the theftproof system of a computer according to the present invention is completed. The device according to the present invention may be installed in the individual client computers or it may be installed only in a server (host computer).

In a state in which the theftproof system of a computer according to the present invention is installed, when the main board of a computer vibrates, the vibration sensor 13 senses the vibration and transmits a sense signal to the circuit 15. The vibration sensing portion 15*e* in the circuit 15 transmits the sense signal from the vibration sensor 13 to the main controller 15*a* after amplifying or converting the sense signal. The main controller 15*a* compares and analyzes the signal and a previously stored reference signal, determines whether something is wrong with the computer, and transmits an alarm sounding command signal to the buzzer 14. Accordingly, the buzzer 14 sounds the alarm. It is possible to prevent the computer, peripheral equipments and the main parts thereof from being stolen by taking immediate measures when it is determined that something is wrong with the computer by the alarm.

Also, when a person passes through a door, the magnetic sensor attached to the door operates and transfers a sense signal to the circuit 15. The external sensor operation sensing portion 15*d* inside the circuit 15 amplifies or converts the sense signal and transfers it to the main controller 15*a*. Then, the main controller 15*a* compares the sense signal with a previously stored reference signal and determines whether something is wrong with the computer. If so, the main controller 15*a* transmits an alarm sounding command signal to the buzzer 14. Accordingly, the buzzer 14 sounds an alarm. When a person enters or exits an office through a door or a window, the infrared sensor attached to the door or the window operates and transfers the sense signal by infrared rays to the circuit 15. Then, the external sensor operation sensing portion 15*d* inside the circuit 15 transmits the sense signal to the main controller 15*a*. The main controller 15*a* compares the sense signal with the previously stored reference signal and determines whether something is wrong with the computer. If so, the main controller 15*a* transmits an alarm sounding command signal to the buzzer 14. Accordingly, the buzzer 14 sounds an alarm.

The above-mentioned situations occur when there is someone in the office. When the above-mentioned situations occurs when there is no one in the office, the main controlling portion 15*a* sends a command signal for transmitting a signal indicating a state of emergency to the state of emergency signal transmitting and receiving portion 15*c*. Then, the state of emergency signal transmitting and receiving portion 15*c* transmits the state of emergency signal to indicate that something is wrong with the computer. Then, the signal is received by the remote controller of a user, which sounds an alarm. Accordingly, the user notices that something is wrong with the computer and takes appropriate measures. The user controls the dip switches 16 in advance so that the state of emergency signal can be transmitted from the system according to the present invention to the remote controller carried by the user when there is no one in the office. The state of emergency signal can be received by the remote controller, a central control room of another location, or a telephone through a phone MODEM. By doing so, it is possible to obtain an unmanned security system.

Figure 4:
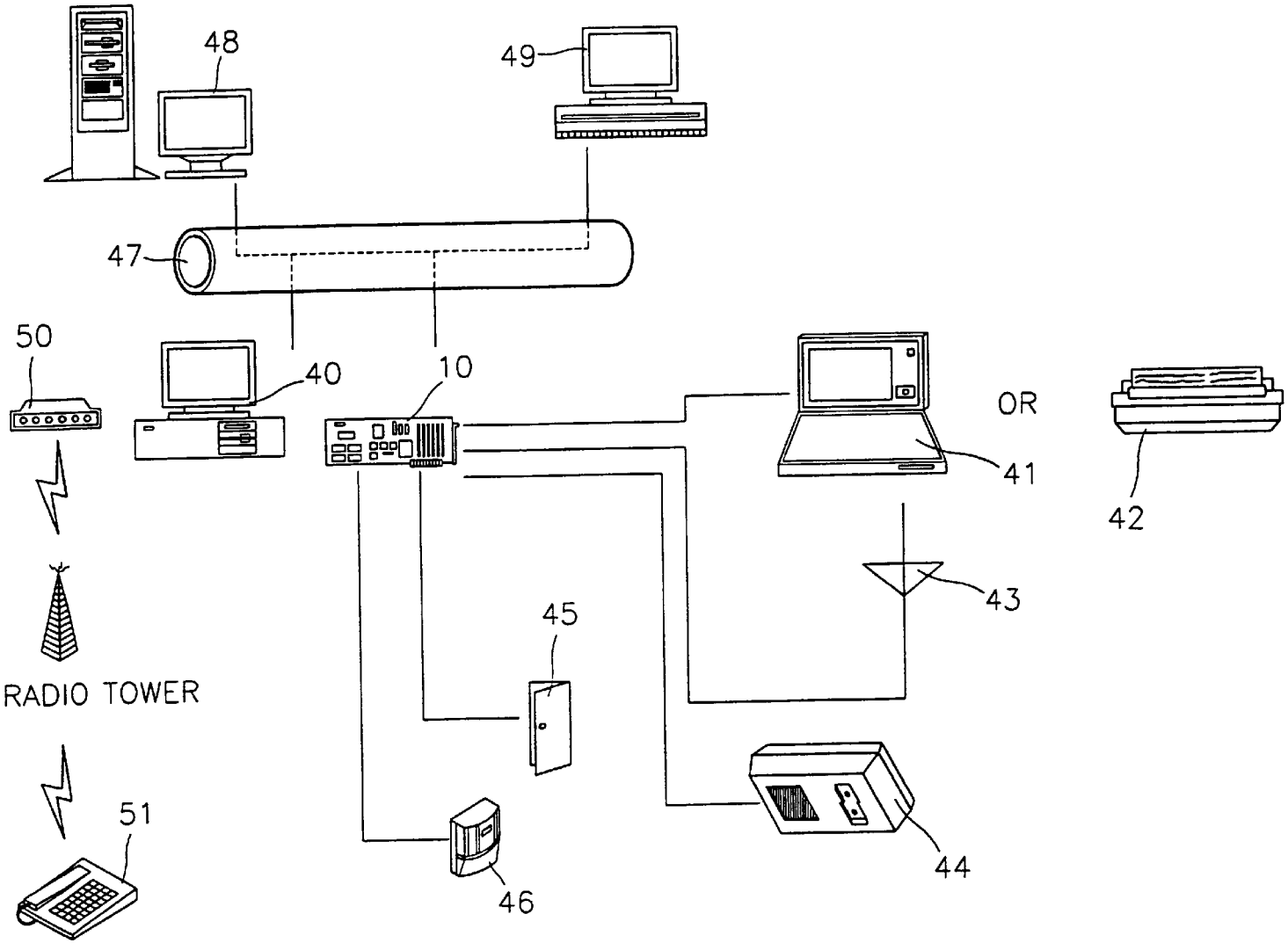
FIG. 4 shows the state of operation of a computer system and peripheral equipments thereof employing the theftproof device according to the present invention.

FIG. 4 shows the state of operation a computer system and peripheral equipments thereof employing the theftproof device according to the present invention.

Referring to FIG. 4, the theftproof device of a computer 10 according to the present invention is installed in an arbitrary computer 40. Here, a notebook computer 41 or a printer 42 is connected to the connector 12*a* of the external connector portion 12. An external antenna 43 is connected to the connector 12*b*. Also, an adaptor 44, a magnetic sensor 45, and an infrared sensor 46 are respectively connected to connectors 12*c*, 12*d* and 12*e*.

The theftproof device 10 according to the present invention can be operated as a single computer system, employed in a computer 40 as mentioned above or as part of a constituting a united computer network system connected to other computers 48 and 49 by a communications means, such as an Ethernet 47. In such a case, a user can take measures by receiving a signal from a computer in the office and a central control at of another location constituting a network. Also, the signal can be received from a home telephone 51 through a computer MODEM 50. By doing so, it is possible to obtain an unmanned security system.

As mentioned above, according to the theftproof device according to the present invention, it is possible to prevent the computer and the main parts thereof from being stolen since an alarm sounds, by the operation of sensors, when the main board of the computer vibrates or the cable for connecting the main board of the computer to peripheral devices is removed. Also, it is possible to control doors by an external sensor and to constitute a system for indicating whether or not something is wrong with the computer by connecting the computer to the remote controller and the central controlling room. Accordingly, it is possible to prevent the computer from being stolen and to obtain a crime prevention effect.

What is claimed is:

1. In combination, a computer system and a concealed theftproof device for said computer system, comprising:

a host computer;

a plurality of connector cables;

peripheral equipment connected to said host computer through said connector cables; and a PCB installed in a predetermined slot of a main terminal board on an inside of said host computer, said PCB having an external connector portion provided on a one side of the PCB for connecting to said connector cables, a vibration sensor installed on the PCB for sensing vibrations of the main board of the computer, an alarm installed on the PCB for sounding an alarm signal when the main board of the computer vibrates, a circuit provided on the PCB for receiving a signal input through the external connector portion, for receiving a signal from the vibration sensor, for controlling the alarm, and for performing communications with the computer system, and dip switches provided on the PCB for setting the communication state between the circuit and the computer system.

said external connector portion comprises, a first connector for a panic sensor for sensing the removal of the connector cable connecting the main terminal board of the host computer to the peripheral equipment, a second connector for an external antenna for transmitting a signal indicating a state of emergency from the circuit to a remote controller, a third connector for an adapter for providing power to the circuit on the PCB, a fourth connector for a magnetic sensor attached to a door, for sensing entrance and exit through said door, and a fifth connector for an infrared sensor installed on one of a door and window for sensing the entrance and exit through said door and window.

2. In combination, a computer system and a concealed theft proof device for said computer system, comprising:

a host computer;

a plurality of connector cables;

peripheral equipment connected to said host computer through said connector cables; and a PCB installed in a predetermined slot of a main terminal board on an inside of said host computer, said PCB having an external connector portion provided on a one side of the PCB for connecting to said connector cables, a vibration sensor installed on the PCB for sensing vibrations of the main board of the computer, an alarm installed on the PCB for sounding an alarm signal when the main board of the computer vibrates, a circuit provided on the PCB for receiving a signal input through the external connector portion, for receiving a signal from the vibration sensor, for controlling the alarm, and for performing communications with the computer system, and dip switches provided on the PCB for setting the communication state between the circuit and the computer system, said circuit comprises, a panic sensing portion for sensing the removal of the connector cable connecting the main terminal board of the computer to the peripheral equipment, a vibration sensing portion for receiving and one of amplifying and converting a sense signal from the vibration sensor, a state of emergency signal transmitting and receiving portion for sensing whether something is wrong with the computer and informing a remote controller of the state of emergency, an external sensor operation sensing portion for sensing whether something is wrong with the computer by an operation of an external sensor, and a main controller for controlling the sensing portions and the signal transmitting and receiving portion of the circuit, receiving signals from the respective sensing portions of the circuit, transmitting an alarm sounding command signal to the alarm, and performing communications with the computer system.

* * * * *